US007334327B1

(12) United States Patent
Chen et al.

(10) Patent No.: US 7,334,327 B1
(45) Date of Patent: Feb. 26, 2008

(54) MANUFACTURING METHOD OF RADIO FREQUENCY CONNECTOR

(75) Inventors: Li-Sen Chen, Taoyuan Hsien (TW); Wen-Hsing Zhang, Taoyuan Hsien (TW); Jia-Wei Li, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 11/309,497

(22) Filed: Aug. 14, 2006

(51) Int. Cl.
*H01R 43/20* (2006.01)

(52) U.S. Cl. ..... 29/876; 29/525.06; 29/874; 29/882; 29/883; 264/104; 264/230; 439/63; 439/581; 439/582

(58) Field of Classification Search ..... 29/876, 29/525.06, 874, 882, 883; 264/104, 230; 439/581, 582, 631
See application file for complete search history.

(56) References Cited

U.S. PATENT DOCUMENTS 5,466,160 A 11/1995 Ogura ..... 439/63
6,474,995 B1 11/2002 Wu ..... 439/63
6,648,653 B2 * 11/2003 Huang et al. ..... 439/63
6,902,408 B2 * 6/2005 Yamane ..... 439/63

* cited by examiner

*Primary Examiner*—Tim Phan
(74) *Attorney, Agent, or Firm*—Jianq Chyun IP Office

(57) ABSTRACT

A method of manufacturing a RF connector includes the following steps. First, a first workpiece with first assembly units is provided. Each first assembly unit includes a first joint piece with a first joint portion, a metal shell with a ring and soldering tags extending therefrom, and a first connection portion connecting the first joint piece and the ring. Next, a second workpiece with second assembly units is provided. Each second assembly unit includes a second joint piece with a second joint portion, a center contact with a base and a center pin disposed thereon, and a second connection portion connecting the second joint piece and the base. Then, the first and second joint portions are positioned to contact with each other and then riveted together. Then, dielectric bodies are formed to at least correspondingly cover part of each ring and each base. Thereafter, a singularizing process is performed.

6 Claims, 8 Drawing Sheets

MANUFACTURING METHOD OF RADIO FREQUENCY CONNECTOR

BACKGROUND OF THE INVENTION

1. Field of the Invention

The present invention relates to a connector and a manufacturing method thereof, and more particularly, to a radio frequency (RF) connector and a manufacturing method thereof.

2. Description of Related Art

RF connectors play a crucial role in various electronic devices as a medium for transmitting electrical signals between the electronic devices and external devices. Recently, with the rapid development of various microelectronic device techniques, the RF connectors have been widely used in various communication equipments (for example, mobile phones).

FIG. 1 is a schematic cross-sectional view of a conventional RF connector. The conventional RF connector has been disclosed in U.S. Pat. No. 5,466,160, and the conventional RF connector 100 comprises an inner conductive pin 110, a hot-line terminal 120, an outer conductor 130, an earth terminal 140 and a dielectric body 150. The inner conductive pin 110 is electrically connected to the hot-line terminal 120, the outer conductor 130 is electrically connected to the earth terminal 140, and the dielectric body 150 is used to maintain the relative positions of the above devices.

However, as the conventional RF connector 100 has a relative small dimension, it is difficult to precisely determine the relative positions between the inner conductive pin 110 and the outer conductor 130 during the injection molding process of the dielectric body 150. Therefore, the appearance and manufacturing method of the conventional RF connector 100 need to be improved.

SUMMARY OF THE INVENTION

An objective of the present invention is to provide an RF connector, wherein the center contact is precisely positioned within the metal shell.

Another objective of the present invention is to provide a method of manufacturing an RF connector, such that the center contact of the RF connector is precisely positioned within the metal shell.

To achieve the above or other objectives, the present invention provides a method of manufacturing an RF connector, which includes the following steps. First, a first workpiece with a plurality of first assembly units is provided. Each of the first assembly units comprises a first joint piece with a first joint portion, a metal shell with a ring and two soldering tags extending from a bottom of the ring, and a first connection portion correspondingly connecting the first joint piece and the ring.

Next, a second workpiece with a plurality of second assembly units is provided. Each of the second assembly units comprises a second joint piece with a second joint portion, a center contact with a base and a center pin disposed on the base, and a second connection portion correspondingly connecting the second joint piece and the base.

Then, each first joint portion and each second joint portion are correspondingly positioned to contact with each other, such that each center pin is correspondingly positioned within each ring. After that, each first joint portion and each second joint portion are correspondingly riveted together, so as to fix a relative position between each metal shell and each corresponding center contact. Then, a plurality of dielectric bodies is formed, wherein each of the dielectric bodies at least correspondingly covers a part of each ring and a part of each base. Thereafter, a singularizing process is performed, so as to form a plurality of independent RF connectors.

In an embodiment of the present invention, each of the first joint portions is a cylindrical body, and each of the second joint portions is a hole. The above method of correspondingly positioning each first joint portion and each second joint portion to be contacted with each other comprises making each first joint portion correspondingly penetrate through each second joint portion. The above method of correspondingly riveting each first joint portion with each second joint portion comprises punching each first joint portion.

In an embodiment of the present invention, each of the above first joint portions is a hole, and each of the second joint portions is a cylindrical body. The above method of correspondingly positioning each first joint portion and each second joint portion to be contacted with each other comprises making each second joint portion correspondingly penetrate through each first joint portion. The above method of correspondingly riveting each first joint portion with each second joint portion comprises punching each second joint portion.

In an embodiment of the present invention, each of the first joint pieces comprises at least one first positioning hole, and each of the second joint pieces comprises at least one second positioning hole. The above method of correspondingly positioning each first joint portion and each second joint portion to be contacted with each other comprises correspondingly stringing and positioning each first positioning hole and each second positioning hole, such that each first joint portion and each second joint portion are correspondingly positioned to contact with each other.

In an embodiment of the present invention, the above method of forming a plurality of dielectric bodies comprises injection molding process.

In an embodiment of the present invention, the above singularizing process separates each ring from the corresponding first connection portion and separates each base from the corresponding second connection portion by punching.

To achieve the above or other objectives, the present invention provides an RF connector, which comprises a metal shell, a center contact and a dielectric body. The metal shell comprises a ring and two soldering tags extending from a bottom of the ring. The center contact comprises a base and a center pin, wherein the center pin is disposed on the base and penetrates through the ring. The dielectric body at least covers a part of the ring and a part of the base, so as to fix a relative position between the metal shell and the center contact.

In view of the above, in the method of manufacturing an RF connector according to the present invention, as each first joint portion and each second joint portion are correspondingly positioned to contact with each other, each center pin can be precisely positioned within each ring. Moreover, in the method of manufacturing an RF connector according to the present invention, as each first joint portion and each corresponding second joint portion are riveted together, the relative position between each center contact and the corresponding metal shell can be fixed. Further, the center contact of the RF connector in the present invention can be precisely positioned within the metal shell.

In order to make the aforementioned and other objectives, features and advantages of the present invention comprehensible, preferred embodiments accompanied with figures are described in detail below.

DESCRIPTION OF EMBODIMENTS

Figure 1:
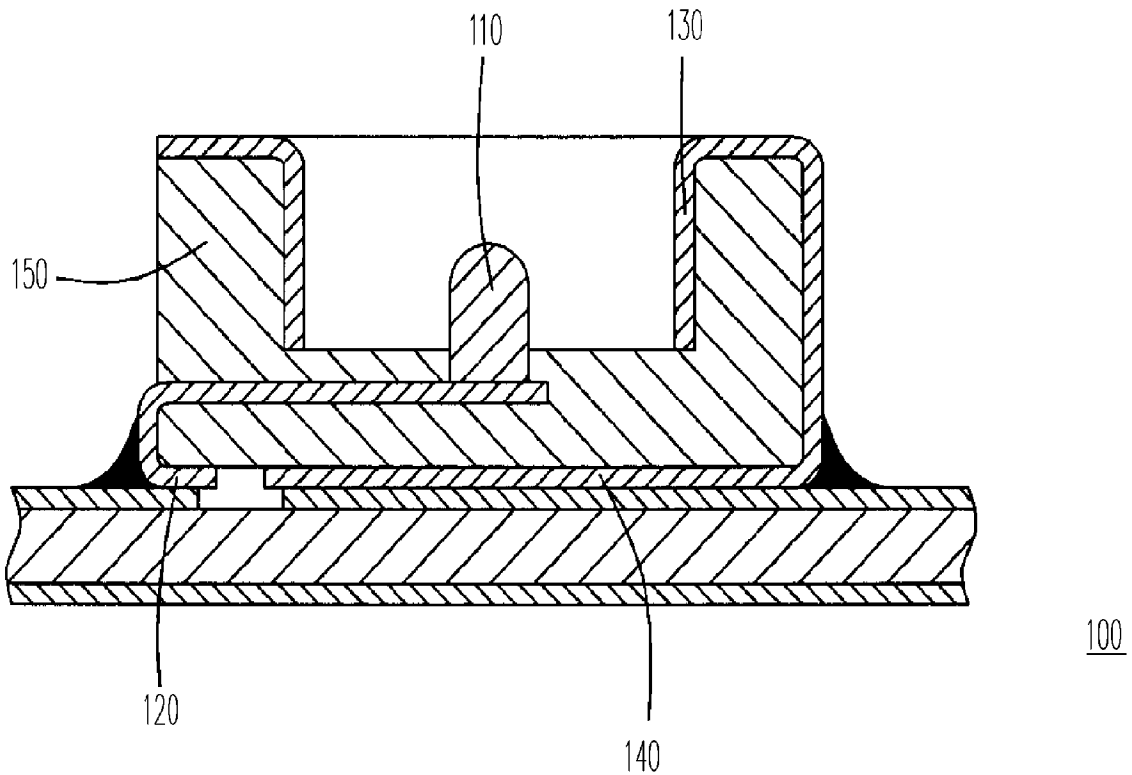
FIG. 1 (PRIOR ART)
FIG. 1 is a schematic cross-sectional view of a conventional RF connector.

FIGS. 2A to 2F are schematic flow charts of a method of manufacturing an RF connector according to an embodiment of the present invention. The method comprises the following steps. First, referring to FIG. 2A, a first workpiece 200 with a plurality of first assembly units 210 is provided. Each of the first assembly units 210 comprises: a first joint piece 212 with a first joint portion 212*a*, a metal shell 214 with a ring 214*a* and two soldering tags 214*b* extending from the bottom B of the ring 214*a*, and a first connection portion 216 correspondingly connecting the first joint piece 212 and the ring 214*a*. In this embodiment, the first assembly units 210 of the first workpiece 200 are formed by punching a metal plate body (not shown).

Figure 2A:
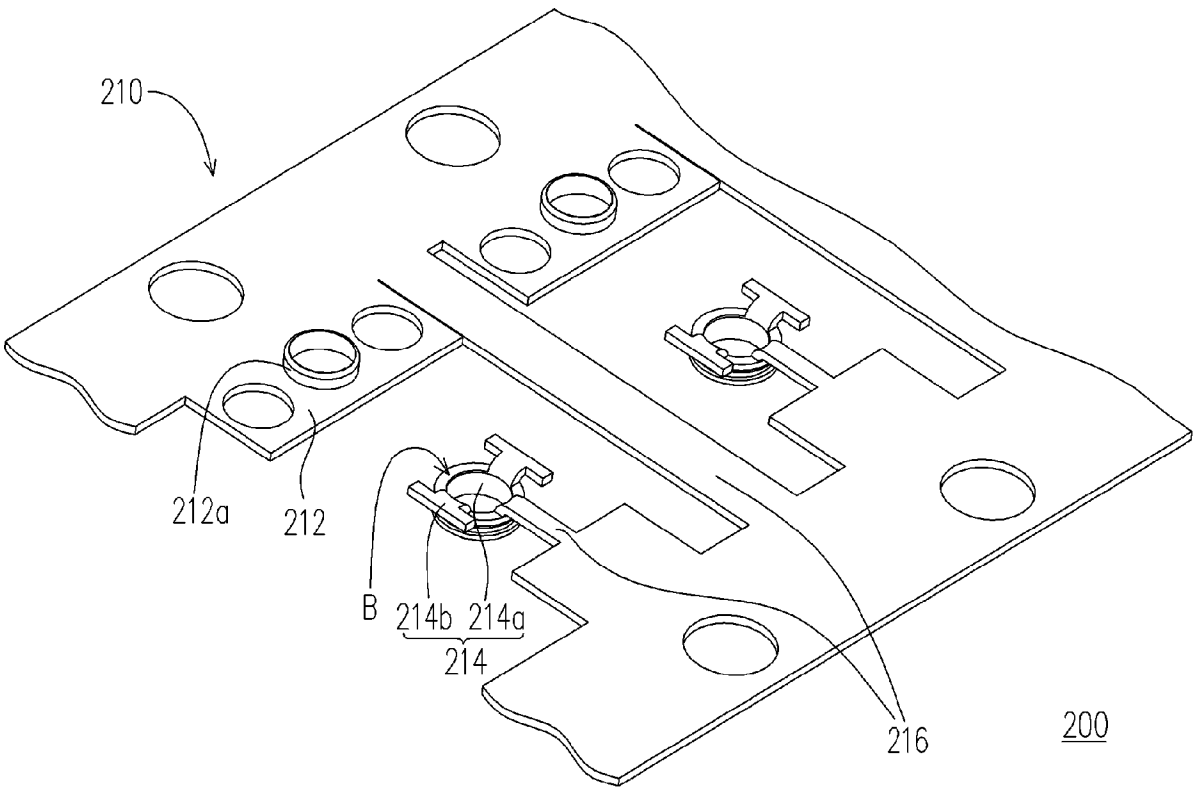
FIGS. 2A to 2F are schematic flow charts of a method of manufacturing an RF connector according to an embodiment of the present invention.
Figure 2B:
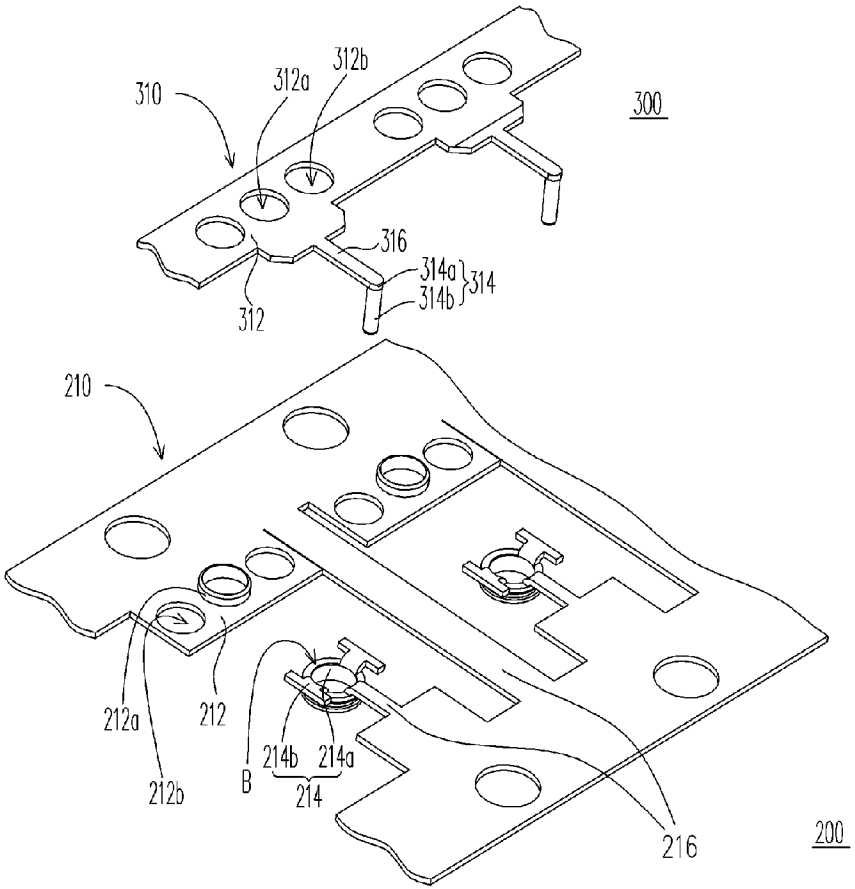

Next, referring to FIG. 2B, a second workpiece 300 with a plurality of second assembly units 310 is provided. Each of the second assembly units 310 comprises: a second joint piece 312 with a second joint portion 312*a*, a center contact 314 with a base 314*a* and a center pin 314*b* disposed on the base 314*a*, and a second connection portion 316 correspondingly connecting the second joint piece 312 and the base 314*a*. In this embodiment, the second assembly units 310 of the second workpiece 300 can be formed by punching another metal plate body (not shown).

Figure 2C:
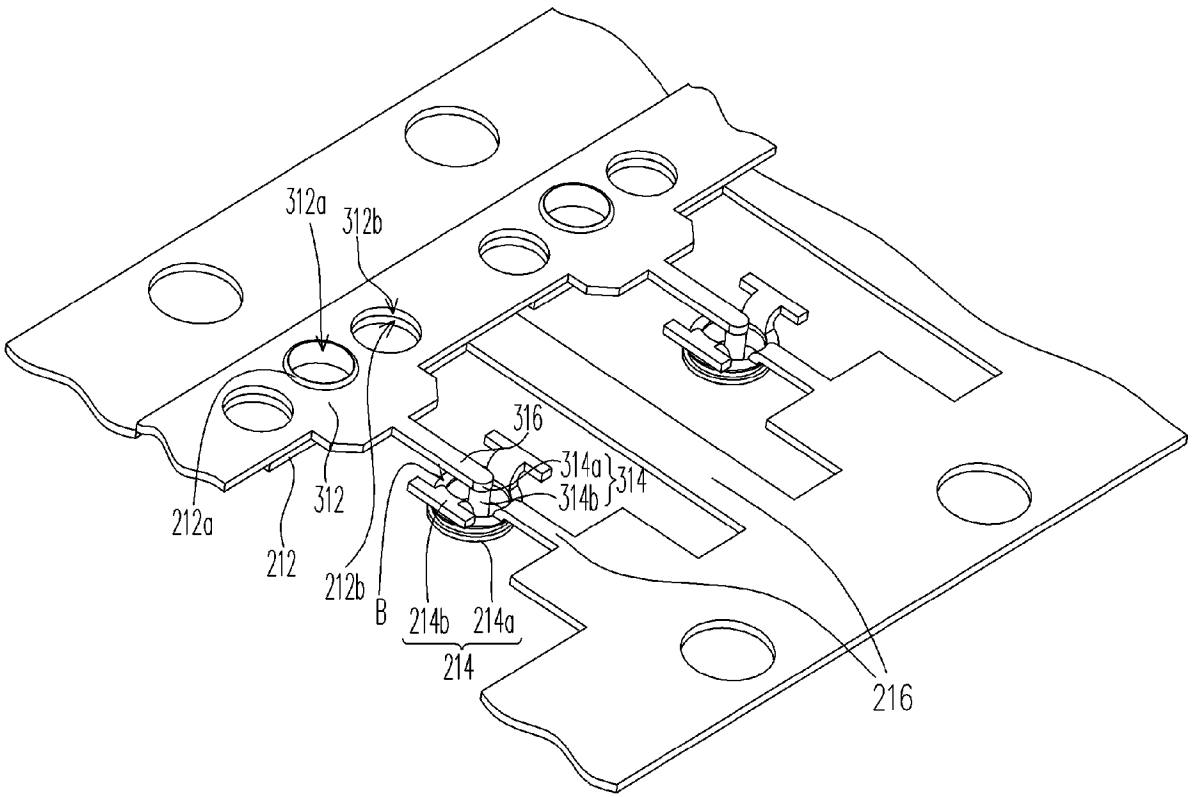

Then, referring to FIG. 2C, each first joint portion 212*a* and each second joint portion 312*a* are correspondingly positioned to contact with each other, such that each center pin 314*b* is correspondingly positioned within each ring 214*a*. It should be noted that, the appearance of the first workpiece 200 and the second workpiece 300 can be changed depending upon the design requirements, as long as the positioning and contacting between each first joint portion 212*a* and each second joint portion 312*a* are not affected and each center pin 314*b* is correspondingly positioned within each ring 214*a*. For example, the position of the metal shells 214 and that of the center contacts 314 can be exchanged. That is, each first assembly unit 210 comprises a first joint piece 212, a center contact 314 and a first connection portion 216, and each second assembly units 310 comprises a second joint piece 312, a metal shell 214 and a second connection portion 316, however, the mentioned example is not shown in the figures.

Furthermore, in this embodiment, each of the first joint portions 212*a* is a cylindrical body, and each of the second joint portions 312*a* is a hole. Additionally, each first joint piece 212 comprises at least one first positioning hole 212*b* (two positioning holes 212*b* in FIG. 2B for demonstration), and each second joint piece 312 comprises at least one second positioning hole 312*b* (two positioning holes 312*b* in FIG. 2B for demonstration). Accordingly, the above method of correspondingly positioning each first joint portion 212*a* and each second joint portion 312*a* to be contacted with each other comprises making each first positioning hole 212*b* and each second positioning hole 312*b* be penetrated by each column (not shown), so as to be correspondingly stringed up and positioned, and each first joint portion 212*a* correspondingly penetrates through each second joint portion 312*a*. Moreover, it should be noted that, the appearance of each first joint portion 212*a* and each second joint portion 312*a* can be changed depending upon the design requirements, for example, each first joint portion 212*a* can be a hole, and each second joint portion 312*a* can be a cylindrical body.

Figure 2D:
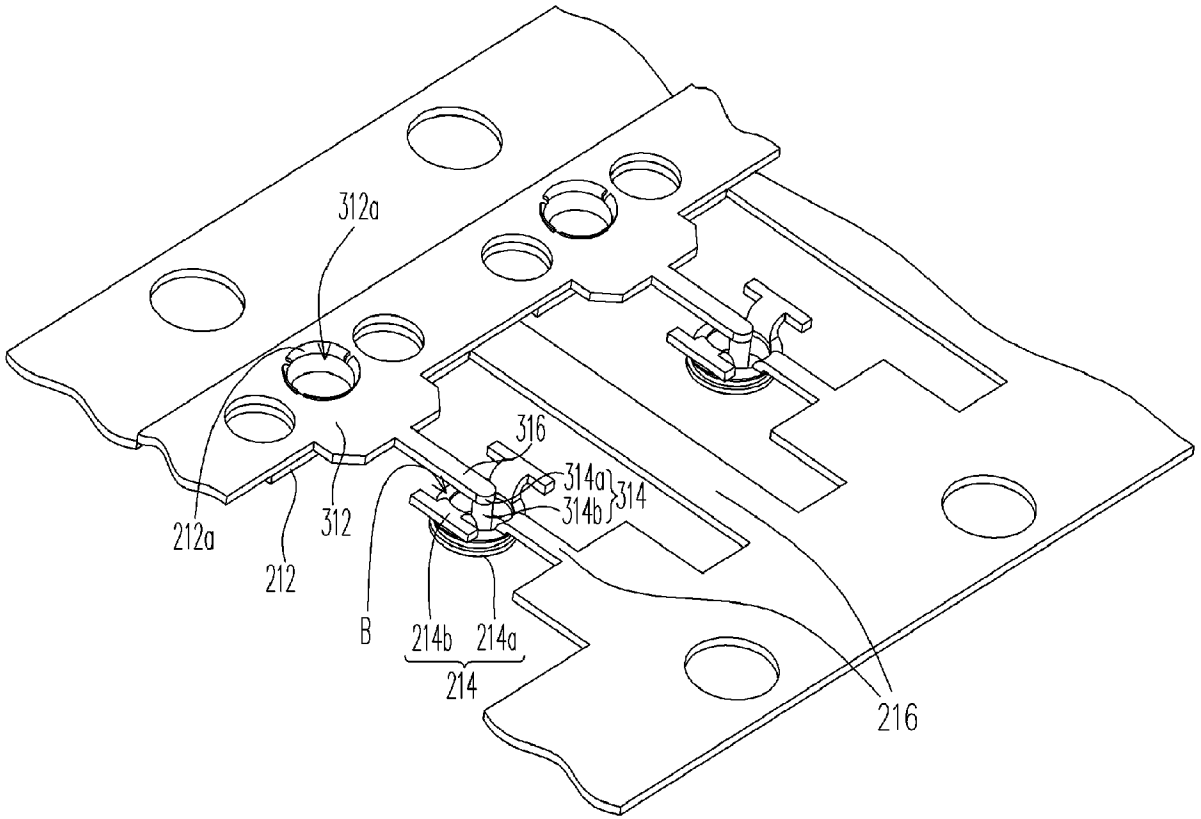

Then, referring to FIG. 2D, each first joint portion 212*a* and each corresponding second joint portion 312*a* are riveted together, so as to fix the relative position between each metal shell 214 and each corresponding center contact 314. In this embodiment, the method of riveting each first joint portion 212*a* with each corresponding second joint portion 312*a* comprises the process of punching each first joint portion 212*a*. It should be noted that, if the first joint portions 212*a* are holes, and the second joint portions 312*a* are cylindrical bodies, the above method comprises the process of punching the second joint portions 312*a*.

As known from the above, as the first joint portions 212*a* and the second joint portions 312*a* are correspondingly positioned to contact with each other, each center pin 314*b* can be precisely positioned within each ring 214*a*. Moreover, as the first joint portions 212*a* and the corresponding second joint portions 312*a* are riveted together, the relative position between each center contact 314 and each corresponding metal shell 214 can be fixed.

Figure 2E:
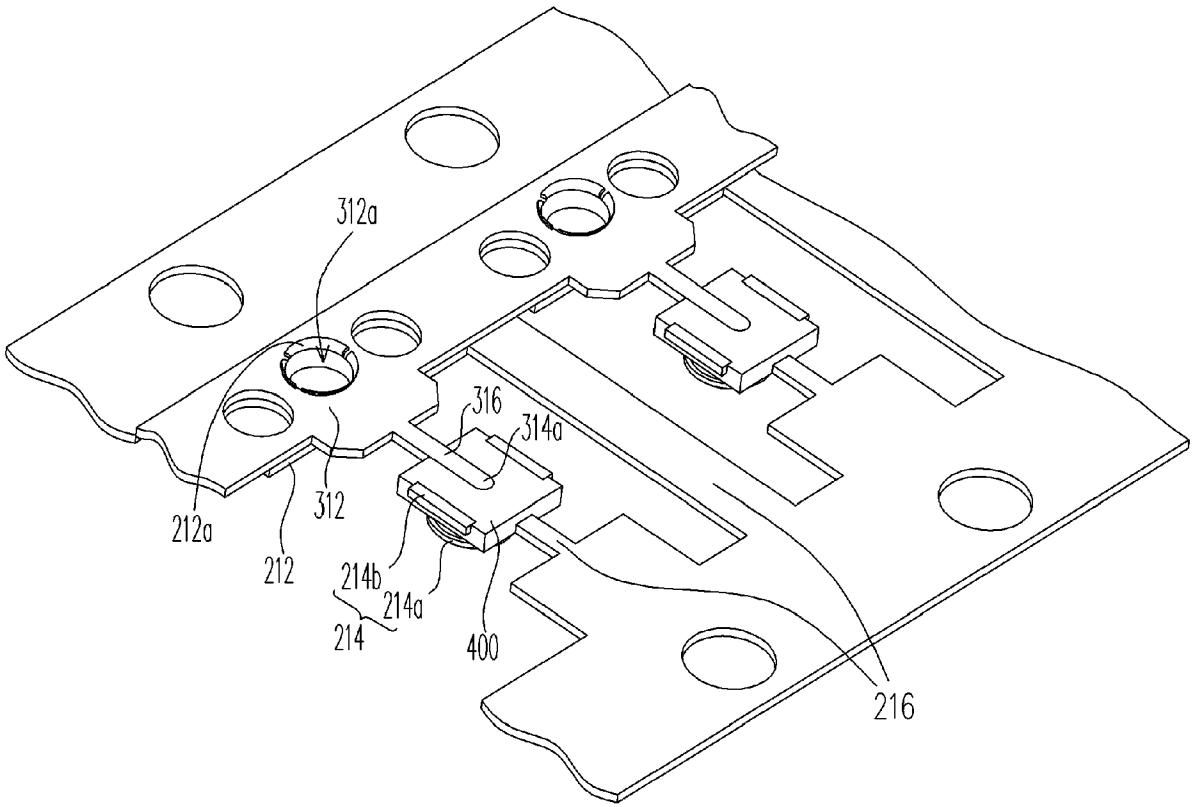

Thereafter, referring to FIG. 2E, a plurality of dielectric bodies 400 may be formed through injection molding process. Each of the dielectric bodies 400 at least correspondingly covers a part of each ring 214*a* and a part of each base 314*a*. In this embodiment, each dielectric body 400 further correspondingly covers a part of each soldering tag 214*b*, a part of each first connection portion 216 and a part of each second connection portion 316.

Figure 2F:
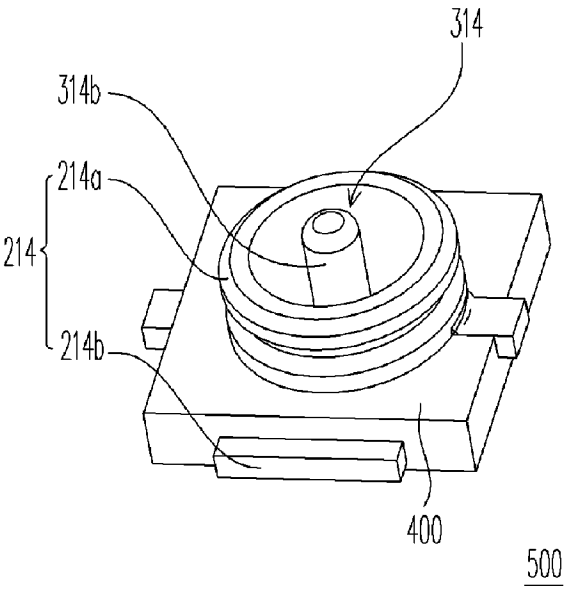

Then, referring to FIG. 2F, the singularizing process may be performed by punching. Each ring 214*a* is separated from each corresponding first connection portion 216, and each base 314*a* is separated from each corresponding second connection portion 316, so as to form a plurality of independent RF connectors 500. As seen from FIG. 2F, the relative position between the metal shell 214 and the center contact 314 of each independent RF connector 500 is fixed and maintained by the dielectric body 400.

Figure 4:
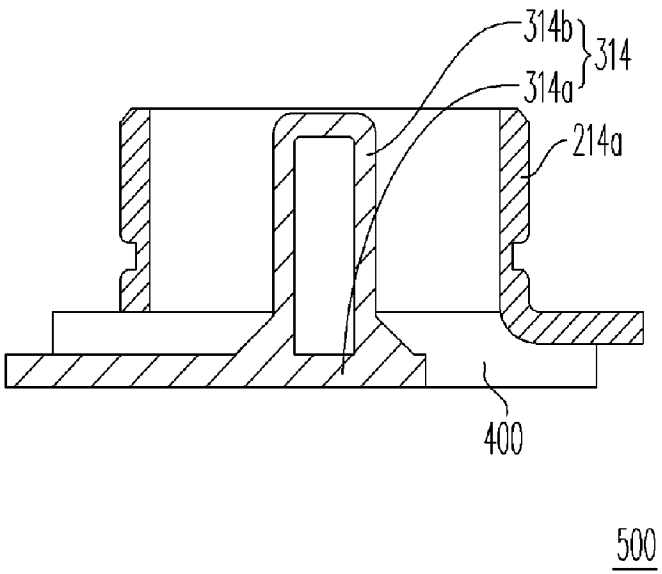
FIG. 4 is a schematic cross-sectional view of the RF connector in FIG. 3.
Figure 3:
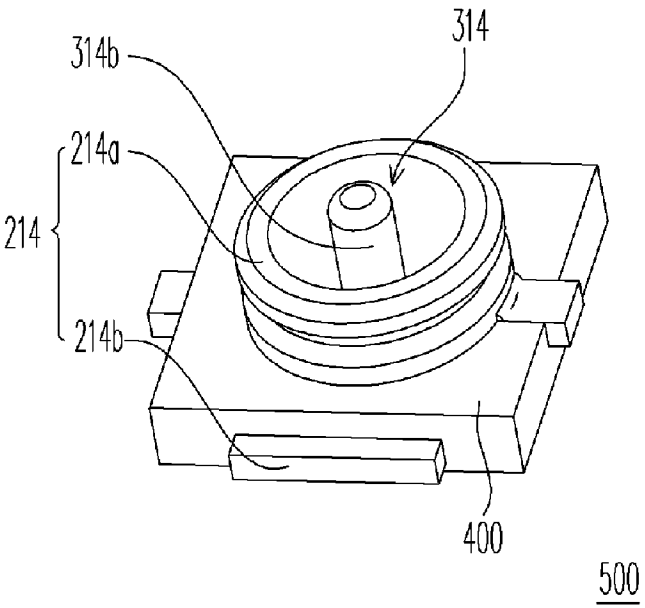
FIG. 3 is a schematic stereogram of an RF connector according to an embodiment of the present invention.

The RF connector 500 is further illustrated below. Referring to FIGS. 3 and 4, FIG. 3 is a schematic stereogram of an RF connector according to an embodiment of the present invention, and FIG. 4 is a schematic cross-sectional view of the RF connector in FIG. 3. The RF connector 500 of this embodiment comprises a metal shell 214, a center contact 314 and a dielectric body 400. The metal shell 214 comprises a ring 214*a* and two soldering tags 214*b* extending from the bottom B of the ring 214*a*. The center contact 314 comprises a base 314*a* and a center pin 314*b*, wherein the center pin 314*b* is disposed on the base 314*a* and penetrates through the ring 214*a*. The dielectric body 400 at least covers a part of the ring 214*a* and a part of the base 314*a*, so as to fix and maintain the relative position between the metal shell 214 and the center contact 314.

When the RF connector 500 is applied to a circuit board (not shown), the soldering tags 214*b* of the metal shell 214 and the base 314*a* of the center contact 314 are all soldered onto the corresponding electric contacts of the circuit board. Further, when another connector (not shown) used for butting is plugged into the RF connector 500, the function of transmitting electrical signals can be achieved.

To sum up, the RF connector and the manufacturing method thereof in the present invention at least have the following advantages.

Firstly, in the method of manufacturing an RF connector according to the present invention, as the first joint portions and the second joint portions are correspondingly positioned to contact with each other, each center pin can be precisely positioned within each ring.

Secondly, in the method of manufacturing an RF connector according to the present invention, as the first joint portions and the corresponding second joint portions are riveted together, the relative position between each center contact and each corresponding metal shell can be fixed.

Thirdly, the center contact of the RF connector in the present invention can be precisely positioned within the metal shell.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims.

What is claimed is:

1. A method of manufacturing a radio frequency (RF) connector, comprising:

providing a first workpiece with a plurality of first assembly units, wherein each of the first assembly its comprises a first joint piece with a first joint portion, a metal shell with a ring and two soldering tags extending from a bottom of the ring, and a first connection portion correspondingly connecting the first joint piece and the ring;

providing a second workpiece with a plurality of second assembly units, wherein each of the second assembly units comprises a second joint piece with a second joint portion, a center contact with a base and a center pin disposed on the base, and a second connection portion correspondingly connecting the second joint piece and the base;

correspondingly positioning the first joint portions and the second joint portions to be contacted with each other, such that each center pin is correspondingly positioned inside each ring;

correspondingly riveting the first joint portions and the second joint portions, such that a relative position between each metal shell and each corresponding center contact is fixed;

forming a plurality of dielectric bodies, wherein each of the dielectric bodies at least correspondingly covers a part of each ring and a part of each base; and performing a singularizing process, so as to form a plurality of independent RF connectors.

2. The method of manufacturing the RF connector as claimed in claim 1, wherein each first joint portion is a cylindrical body and each second joint portion is a hole; and the step of correspondingly positioning the first joint portions and the second joint portions to be contacted with each other comprises making the first joint portions correspondingly penetrate through the second joint portions; and the step of riveting the first joint portions with the corresponding second joint portions comprises punching the first joint portions.

3. The method of manufacturing the RF connector as claimed in claim 1, wherein each first joint portion is a hole and each second joint portion is a cylindrical body; and the step of correspondingly positioning the first joint portions and the second joint portions to be contacted with each other comprises making the second joint portions correspondingly penetrate through the first joint portions; and the step of riveting, the first joint portions with the corresponding second joint portions comprises punching the second joint portions.

4. The method of manufacturing the RF connector as claimed in claim 1, wherein each of the first joint pieces comprises at least one first positioning hole, and each of the second joint pieces comprises at least one second positioning hole; the step of correspondingly positioning the first joint portions and the second joint portions to be contacted with each other comprises correspondingly stringing and positioning the first positioning holes and the second positioning holes, such that each of the first joint portions and each of the second joint portions contact with each other.

5. The method of manufacturing the RF connector as claimed in claim 1, wherein the step of forming a plurality of dielectric bodies comprises injection molding process.

6. The method of manufacturing the RF connector as claimed in claim 1, wherein the singularizing process separates each ring from each corresponding first connection portion, and separates each base from each corresponding second connection portion by punching.

* * * * *